US012262763B2

(12) United States Patent
Crompton

(10) Patent No.: US 12,262,763 B2
(45) Date of Patent: Apr. 1, 2025

(54) BRASSIERE WITH ANCHORED UNDER SUPPORTS

(71) Applicant: Sculpted U, Inc., West Palm Beach, FL (US)

(72) Inventor: Elizabeth A. Crompton, West Palm Beach, FL (US)

(73) Assignee: Sculpted U, Inc., West Palm Beach, FL (US)

( * ) Notice: Subject to any disclaimer, the term of this patent is extended or adjusted under 35 U.S.C. 154(b) by 0 days.

(21) Appl. No.: 18/482,536

(22) Filed: Oct. 6, 2023

(65) Prior Publication Data

US 2024/0032615 A1 Feb. 1, 2024

Related U.S. Application Data

(63) Continuation of application No. 17/862,557, filed on Jul. 12, 2022, which is a continuation of application No. 16/883,430, filed on May 26, 2020, now Pat. No. 11,412,786, which is a continuation of application No. 16/005,606, filed on Jun. 11, 2018, now Pat. No. 10,694,789, which is a continuation of application No. 14/912,536, filed as application No. (Continued)

(51) Int. Cl.
*A41C 3/12* (2006.01)
*A41C 3/00* (2006.01)

(52) U.S. Cl.
CPC ..... *A41C 3/122* (2013.01); *A41C 3/0028* (2013.01)

(58) Field of Classification Search
CPC ..... A41C 3/122; A41C 3/0028
USPC ..... 450/52
See application file for complete search history.

(56) References Cited

U.S. PATENT DOCUMENTS

| | | | |
|---|---|---|---|
| 3,030,633 | A | 4/1962 | Chalfin |
| 3,351,954 | A | 11/1967 | Chalfin et al. |
| 3,747,606 | A | 7/1973 | Tareau |

(Continued)

FOREIGN PATENT DOCUMENTS

| | | |
|---|---|---|
| CH | 271095 | 10/1950 |
| FR | 70656 | 6/1959 |

(Continued)

OTHER PUBLICATIONS

U.S. Pat. No. 351,807, Skinner, issued on Nov. 2, 1886.
International Search Report and the Written Opinion of the International Searching Authority mailed Dec. 11, 2014.

*Primary Examiner* — Gloria M Hale
(74) *Attorney, Agent, or Firm* — Rothwell, Figg, Ernst and Manbeck, P.C.

(57) ABSTRACT

An under support for a breast support cup in a brassiere. The under support is rigid and has varying widths and differing radii to accommodate the bottom portion shape of a natural breast or a breast implant. The under support is configured to keep the proximal edge in proximity with bottom portion of the breast tissues or implant and the ribs. The under support has its largest width, thereby the largest contact surface with the implant or breast tissues, closest to the lateral end causing the breast tissues or implant to be supported upward and medially. The under support has openings or anchors extending therefrom with openings to allow a foam or other brassiere material to surround and go through the under support to secure it in place in the brassiere.

12 Claims, 15 Drawing Sheets

Related U.S. Application Data

PCT/US2014/051843 on Aug. 20, 2014, now Pat. No. 9,993,038.

(60) Provisional application No. 61/867,713, filed on Aug. 20, 2013.

(56) References Cited

U.S. PATENT DOCUMENTS

| | | | | |
|---|---|---|---|---|
| 4,235,240 | A | 11/1980 | Cousins | |
| 5,334,082 | A | 8/1994 | Barker | |
| 6,186,862 | B1 | 2/2001 | Fildan | |
| 6,213,841 | B1 | 4/2001 | Kuo | |
| 6,324,703 | B1 * | 12/2001 | Chen | C08L 53/025 2/457 |
| 6,431,946 | B1 | 8/2002 | Fildan et al. | |
| 6,575,881 | B2 | 6/2003 | Lapcevic | |
| 7,234,994 | B2 | 6/2007 | Fildan et al. | |
| 7,377,833 | B1 | 5/2008 | Wanzenboeck et al. | |
| 8,105,130 | B2 | 1/2012 | Fildan et al. | |
| 9,364,031 | B2 | 6/2016 | Crompton | |
| 9,993,038 | B2 | 6/2018 | Crompton | |
| 10,694,789 | B2 | 6/2020 | Crompton | |
| 11,412,786 | B2 | 8/2022 | Crompton | |
| 2007/0087659 | A1 * | 4/2007 | Fildan | A41C 3/128 450/41 |
| 2007/0087660 | A1 | 4/2007 | Fildan et al. | |
| 2011/0136405 | A1 | 6/2011 | Sturman et al. | |
| 2013/0137340 | A1 | 5/2013 | Liu | |
| 2013/0165017 | A1 * | 6/2013 | Liu | A41C 3/146 450/38 |
| 2013/0295819 | A1 | 11/2013 | Liang | |
| 2014/0073222 | A1 | 3/2014 | Turlan-Van Der Hoeven et al. | |
| 2016/0198775 | A1 | 7/2016 | Crompton | |
| 2018/0352874 | A1 * | 12/2018 | Cahan | A41C 3/08 |

FOREIGN PATENT DOCUMENTS

| | | |
|---|---|---|
| GB | 249816 | 2/2013 |
| KR | 20100010553 | 10/2010 |
| WO | 2000047068 | 8/2000 |

* cited by examiner

| Implant size (cc) | Percentage in Global Market |
|---|---|
| 125 | 0.2% |
| 150 | 0.6% |
| 175 | 0.7% |
| 200 | 1.6% |
| 225 | 1.7% |
| 250 | 3.6% |
| 275 | 4.6% |
| 300 | 7.5% |
| 325 | 7.7% |
| 350 | 10.6% |
| 375 | 8.6% |
| 400 | 10.5% |
| 425 | 5.3% |
| 450 | 8.5% |
| 475 | 2.9% |
| 500 | 7.0% |
| 550 | 5.2% |
| 600 | 4.3% |
| 650 | 2.5% |
| 700 | 2.4% |
| 750 | 1.0% |
| 800 | 2.8% |

Fig. 11

| Volume | Diameter(cm) | Projection(cm) |
|---|---|---|
| 125 | 8.3 | 3.5 |
| 150 | 8.8 | 3.7 |
| 175 | 9.3 | 3.9 |
| 200 | 9.7 | 4.0 |
| 225 | 10.1 | 4.2 |
| 250 | 10.5 | 4.3 |
| 275 | 10.8 | 4.4 |
| 300 | 11.1 | 4.5 |
| 325 | 11.4 | 4.6 |
| 350 | 11.7 | 4.8 |
| 375 | 12.0 | 4.8 |
| 400 | 12.2 | 5.0 |
| 425 | 12.5 | 5.0 |
| 450 | 12.8 | 5.1 |
| 475 | 12.9 | 5.3 |
| 500 | 13.2 | 5.3 |
| 550 | 13.6 | 5.5 |
| 600 | 14.0 | 5.6 |
| 650 | 14.4 | 5.7 |
| 700 | 14.8 | 5.8 |
| 750 | 15.1 | 5.9 |
| 800 | 15.5 | 6.0 |

Fig. 12

BRASSIERE WITH ANCHORED UNDER SUPPORTS

CROSS REFERENCE TO RELATED APPLICATIONS

This application is a continuation of U.S. application Ser. No. 17/862,557 filed Jul. 12, 2022, now U.S. Pat. No. 11,812,796, issued Nov. 14, 2023, which is a continuation of U.S. application Ser. No. 16/883,430, filed May 26, 2020, now U.S. Pat. No. 11,412,786, issued Aug. 16, 2022, which is a continuation application of U.S. application Ser. No. 16/005,606, filed Jun. 11, 2018, now U.S. Pat. No. 10,694,789, issued Jun. 30, 2020, which is a continuation application of U.S. application Ser. No. 14/912,536, filed Feb. 17, 2016, now U.S. Pat. No. 9,993,038, issued Jun. 12, 2018, and entitled "Brassiere with Anchored Under Supports", which is a § 371 National Stage application of International Patent Application No. PCT/US2014/051843, filed Aug. 20, 2014, and entitled "Brassiere with Anchored Under Supports" which claims priority to and the benefit of U.S. provisional patent application Ser. No. 61/867,713, filed Aug. 20, 2013 and entitled "Brassiere with Anchored Under Supports," each of which are incorporated by reference herein in their entireties.

FIELD OF THE INVENTION

This invention relates generally to the field of brassieres and, in particular, to an improved brassiere having a three dimensional underwire for supporting and cradling a breast in a manner resulting in both comfort and enhancement.

BACKGROUND

A brassiere is an undergarment for supporting and covering the breasts of a woman. A conventional brassiere is known to hold a women's breasts, as compared with supporting a women's breasts. This distinction is most important in woman who have breast augmentation which has become a universal way of enhancing a women's appearance. Unfortunately, a women who has undergone breast augmentation typically employs a conventional brassiere which can lead to discomfort or pain. For purposes of simplicity, the improvements disclosed will be directed for use with a woman who has undergone breast augmentation as she is most likely to immediately understand the lack of support. However, this invention is applicable for use by any woman who can benefit from a brassier capable of actually supporting the breasts.

Breast implants are manufactured in a range of sizes that allows a woman to determine the size that best suits her appearance, needs, and expectations. Breast implant surgery is applicable for a variety of reasons including: correcting the size, form, and feel of a breast in post-mastectomy reconstruction; correcting congenital defects and deformities of the chest wall; and for aesthetic breast augmentation. Breast augmentation can be used to address psychological distress in woman who are concerned about their appearance and self-image. Breast augmentation can create a physiological sense of fulfillment and security in the woman's body that would have been difficult to obtain otherwise, even with the use of a push-up brassiere or breast pads. No matter what size implant is chosen, the woman will not only experience instant aesthetic enhancement but will also experience a new awareness due to the weight and positioning of the implant. This is especially noticeable directly after the enhancement. The weight of the implant is dependent upon the size of the implant and its positioning may vary from quite close to a wider proximity to the other breast. Determining factors include shape of the existing breast, physical build of the recipient, and the recipient's personal preference.

A brassiere consists of two cups for breasts, a center panel, a band running around the torso under the breasts, and shoulder straps (some brassieres are strapless). Brassieres are typically constructed of a fabric such as cotton, polyester, or the like. The brassiere is usually fastened with a hook fastener on the band or between the cups. Still others are pulled on over the head and have no fasteners. Women can also wear brassieres to improve the shape of their breasts and to enlarge the perceived breast size. Further, proper brassiere sizing helps to restrain breast movement during an activity. Most commonly, brassieres are designed to simply restrain the breasts from movement.

Brassieres which contain padding are designed to increase comfort and to create the illusion of a larger breast size. One example is the pushup bra, where padding is added at the bottom of each breast cup in order to fill the bottom of the cup and push the breasts upward. By gathering the majority of the breast tissue towards the top of the cup, the top of the breasts can appear more round. One problem with using padding at the bottom of the brassier to push up the breast is that the breast can overflow the cup, which fails to create a desired smooth and round effect. Another problem associated with a padded brassiere is that elevating the breasts in this manner will not necessarily position them in a way that fills the top of the cup and creates the desired round shape. This may occur as the shape created at the top of the cup will be dependent upon the individual shape of the breasts being elevated. Thus, the illusion of roundness created by the brassiere will vary depending upon the shape and size of the wearer's breast. Fortunately, a woman with breast augmentation already has a round individual shape to her breasts so the desired effect is more easily created.

The cups on most brassiere, including pushup bras, are supported by underwires made of metal which sometimes may be coated in plastic. Strapless brassieres typically rely on support provided by the band and underwire positioned under the bust. It is well known that there are a wide variety of underwire bras. The lower edge of the bra cup is lined with the semi-circular underwire. The use of an underwire bra, as opposed to a non-underwire bra, ensures that a hypermammiferous woman will receive adequate breast support. Typically, the underwire support has a semi-circular configuration with varying lengths. Most commonly two types of underwire brassiere construction exist: the first with a pair of separate underwires received in a channel formed below each cup of the brassiere; and the second with a single underwire frame with respective portions received in such channels beneath each cup and joined together at the front of the brassiere.

In the separate underwire construction, the underwire typically extends about the base of the cup with an outer leg extending substantially upwards towards the outer top of the cup, and an inner leg also extending upwards, but towards the inner top of the cup. As a result, the underwire bra is typically of a push-up type which attempts to raise the wearer's breast in a more or less vertical direction. The underwire should conform and cling to the skin of the wearer in a manner that should preclude lifting of the band of the bra which passes about the torso of the wearer, thereby ensuring that the bottom portion of the breast cannot fall between the wearer and the band. Additionally, the underwire helps support the breast within the cup, thereby relieving the strain often placed upon by the bra shoulder straps and hence the shoulders of the wearer.

Most of the existing underwires in the art are made by bending the relatively flexible metal strip into the semi-circular shape or having the semi-circular underwire constructed in advance of a comparatively stiff material. However, the planar configuration of the underwire is rarely consistent with the hemispherical shape of the cup and the bottom portion of a breast which in turn creates an underwire with inadequate support. Also, an imprint of the underwire tends to be left on the body of the user, which is not pleasing to the wearer. Should the underwire exert extreme pressure it may actually have an impact on the breast implant under the skin and very noticeable indentations and severe pain may be experienced with use of such underwire bras. Then repeated use could eventually cause implant failure. While some underwires may be relatively flexible to assume the shape imparted on by the woman's body and bra, this relative flexibility may also compromise the relative support needed beneath the breast.

While the underwires of the prior art have achieved widespread usage, certain disadvantages result from their use. These disadvantages relate to the varying degrees of stiffness encountered following construction of the underwire. The relative stiffness of conventional underwires causes discomfort and the uniformity of stiffness provides a lack of adaptability to the needs of various users. Other underwires possess a constant cross-section throughout their length and so do not provide a desired variable level of support as the weight of the breast is not evenly dispersed. Further when a desired cleavage effect (upwardly to the neckline and inwardly toward the opposite breast) is wanted, they fail to provide an essential support along a greater surface area of the breast. Other disadvantages relate to the positioning of the underwire within the band of the brassiere. A very specific disadvantage occurs when the underwire within the band does not provide sufficient support to a wearer who had breast augmentation as it does not capture and hold the breast, more specifically the implant, in a position that upwardly lifts and maintains the breast.

SUMMARY

An improved brassiere for persons having a particular advantage for use with persons that have augmented breasts or larger natural breasts. The brassiere is formed of an inner garment base, memory foam filler, under supports, and an outer fabric cover. The memory foam filler encapsulates the upper support and is positioned between the inner garment base and outer fabric. The memory foam filler has varying thickness about the lower lateral portion of the breast cup to facilitate in supporting the breast upward and medially. The under support is preferably formed from a piece of plastic material. Its construction is such that it has: rigidity from the distal edge to the proximal edge; flexibility and varying width from a medial end to lateral end; and, differing radii to accommodate the bottom portion shape of breast tis sues or a breast implant, which is not a perfect semi-circle.

The under support is set on a coronal plane to cradle, support, and hold the breast tissues or breast implant. The positioning of the under support is such that the foam will surround it to keep the proximal edge, which is constructed and arranged to outline the shape of the bottom portion of a natural breast or breast implant and the ribs, in contact with the breast tissues, breast implant, and the ribs. The largest width of the under support is closest to the lateral edge, then the width transitions to its largest surface area at a supporting enlarged section, which is offset the lateral edge, and subsequently tapers into the medial edge. The under support construction allows for greater contact area between the breast tissues or breast implant and its enlarged linesection causing the breast tissues or breast implant to be supported upward and medially.

Accordingly, it is an objective of the instant invention to provide an improved brassiere whereby each under support should lie flat against the sternum (not the breast), along the infra-mamary fold, and should not dig into, rub, or poke the chest or the breasts. Additionally, the under support lifts the breasts upward and medially, projecting them toward the neckline and inward toward each other to emphasize cleavage without excessively squeezing or constricting them while still providing different degrees of support to different areas of the breasts by way of an under support which has a non-uniform flexibility imparted by variations in width and radius.

It is a further objective of the instant invention to provide a brassiere that properly lifts the breast to prevent repositioning, such as sagging, that is comfortable to wear and does not leave indent traces of the under support on the wearer. The brassiere is suited for both smaller and larger breasted women who had received breast augmentation for purposes of enhancing their appearance by maintaining proper positioning of breast tissues or breast implants.

It is yet another objective of the instant invention to provide a brassiere under support that may be constructed of metal, metal alloy, plastic, plastic composite, fiberglass, epoxy, carbon-graphite, or the like.

It is further an objective of the instant invention to provide a bra that, although suited for women with implants, is also suitable for natural breast.

It is a still further objective of the instant invention to include a pair of lift pads for a brassiere positioned between an inner bra fabric and an outer bra fabric on each breast cup to augment the breast in certain areas, creating the illusion of a rounder breast, while not sacrificing the fit of the cup.

It is an additional objective of the instant invention to position the under supports between the memory foam fillers, and not within the brassiere under band as seen in the prior art, to create a sling-like mechanism on the coronal plane that causes the under support to cradle the breast, including breast tissues or a breast implant, pushing the breast upwards and medially.

It is yet further an objective of the instant invention to have a memory foam filler with varying thickness about the lower lateral portion of the breast cup to facilitate in supporting the breast upward and medially.

It is yet another additional objective of the instant invention to provide an under support having a larger surface area to give greater area of contact between the support and the breast thus achieving a better supporting effect. The varying width provides varying degrees of support to breast tissues or an implant, with maximum support provided about the supporting enlarged section. The width graduates from a minimum at each end of the under support to a maximum about the supporting enlarged section. Thus it provides an under support where the first transition of width (which is offset towards the lateral edge) between a lateral end the enlarged section has a larger width than the second transition of width, so as to simultaneously push the breast upwards and medially.

It is yet another additional objective of the instant invention to provide an under support with features for anchoring the support within a memory foam filler. In some configurations, the under support can include openings through which the memory foam can extend in an around the under support. Alternative or in combination with such openings in the under support, the under support can further include one or more anchors extending from the under support, each of the anchors including one or more openings.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 11 is a table of the average implant size distribution on the global market;

FIG. 12 is a table of typical implant diameter and implant projection for various volume ranges;

DETAILED DESCRIPTION

Figure 1:
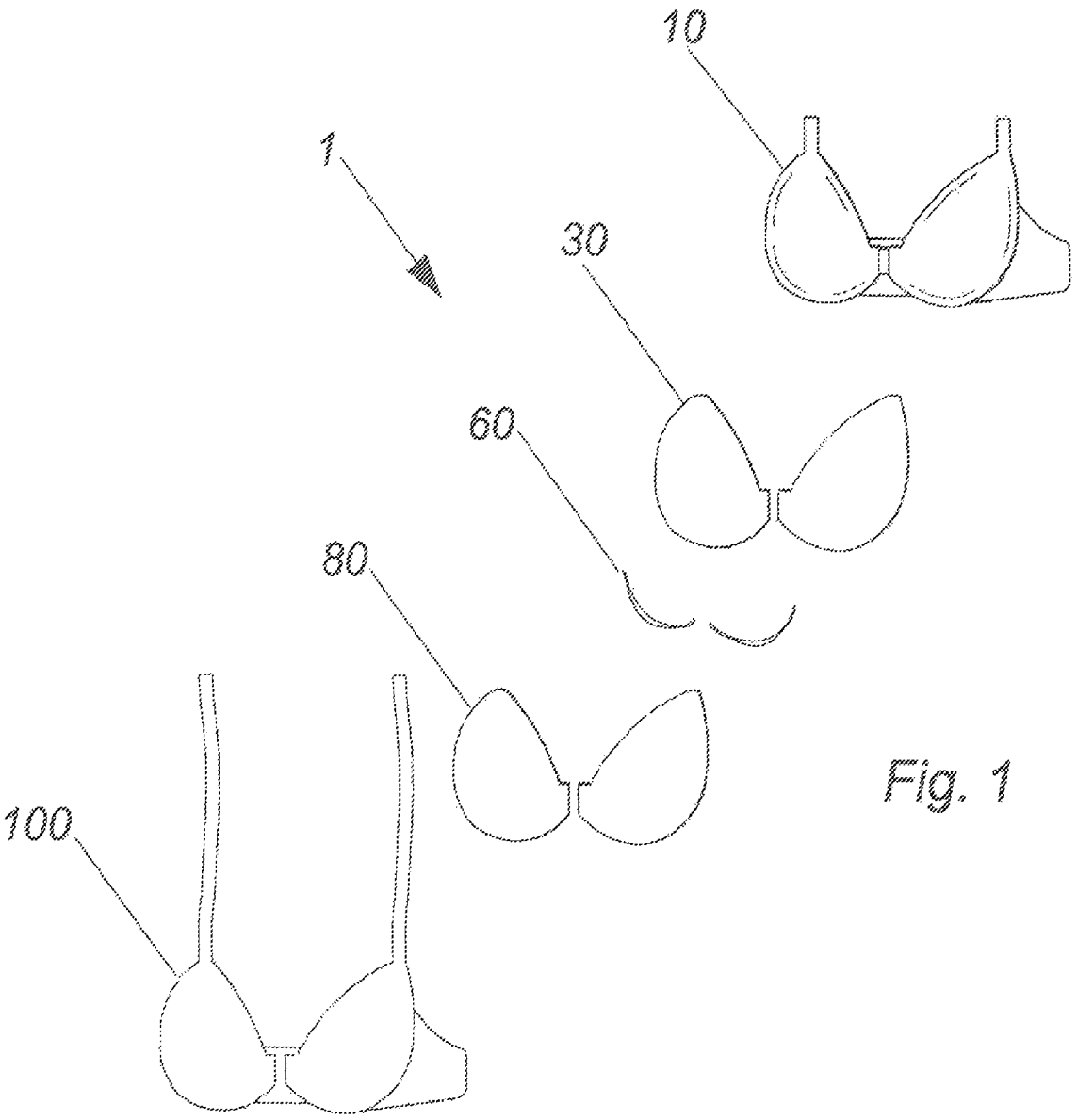
FIG. 1 is an exploded view of the improved brassiere.
Figure 2:
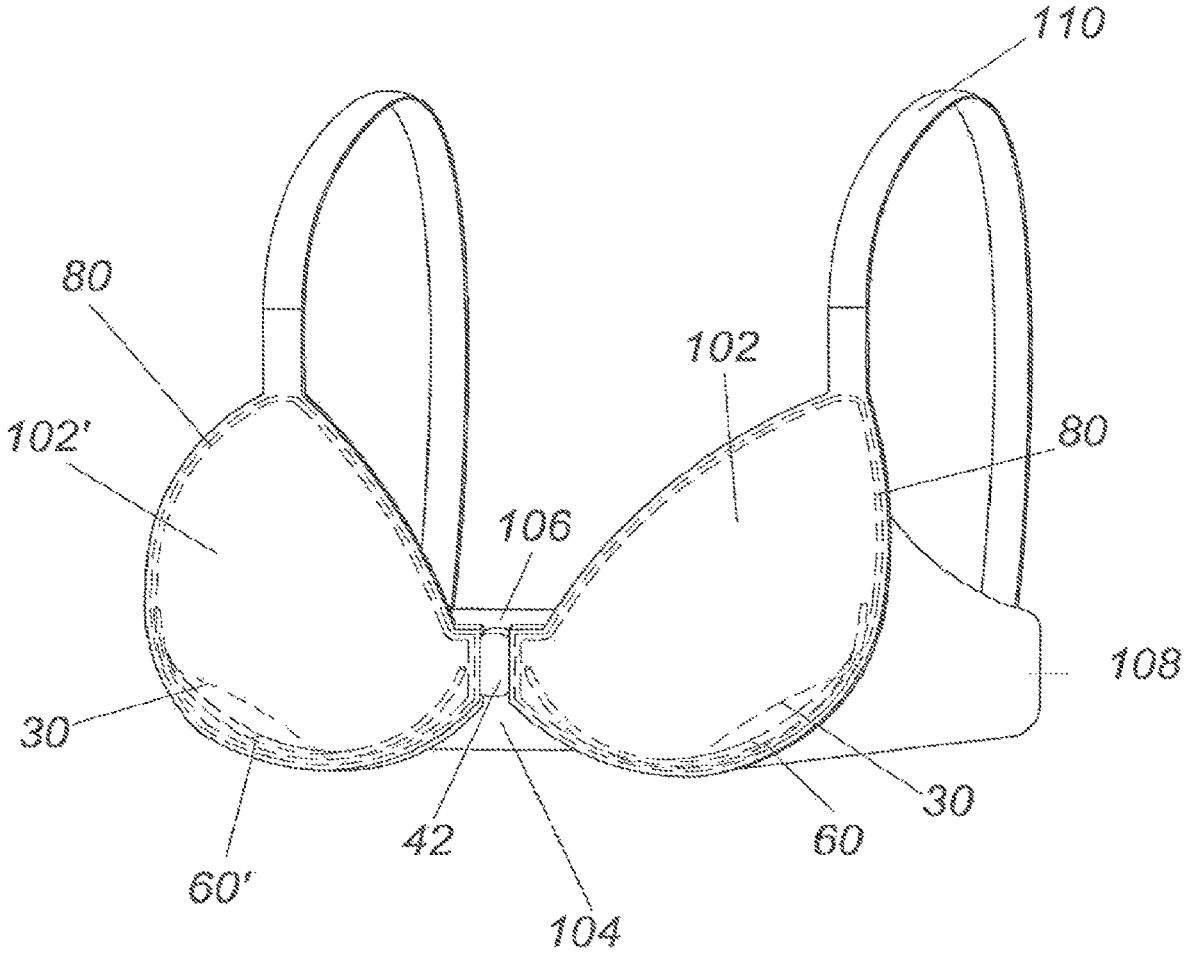
FIG. 2 is a front perspective view of the of the improved brassiere.
Figure 3:
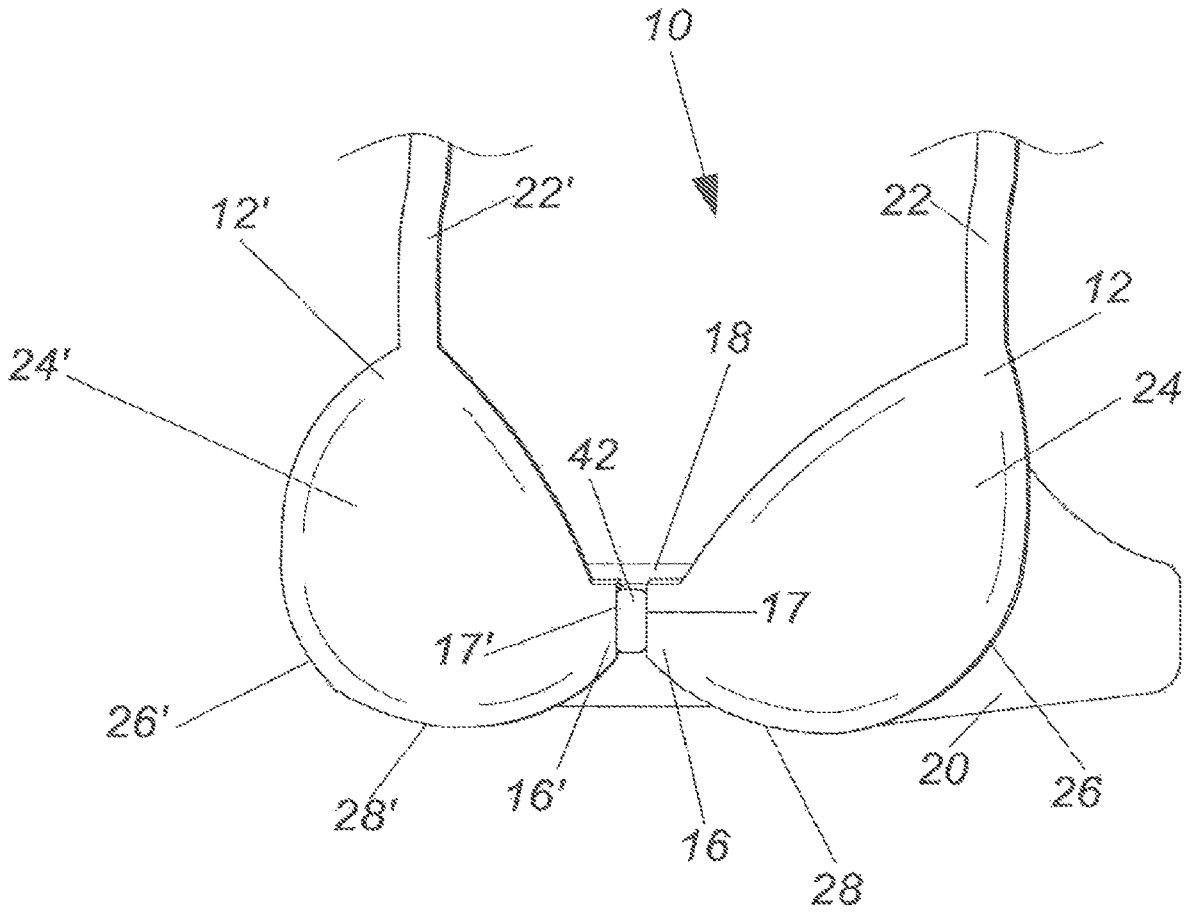
FIG. 3 is a front perspective view of the inner garment base of the instant invention.

As shown in FIGS. 1 and 2, the brassiere 1 of the instant invention is formed from an inner garment base 10, a first memory foam filler 30, under supports 60, a second memory foam filler 80, and an outer fabric cover 100. The inner garment base 10, as shown in FIG. 3, is more specifically defined by a left base garment piece 12 and a right base garment piece 12' (it should be noted that the mark "'" following the numeral is to signify the right side), each having a front section 16, a back section 18, a lateral section 20 for joining the front section 16 and back section 18 under an arm of a woman's torso, and a shoulder strap 22 for joining the front section 16 and back section 18 over each shoulder of a woman's torso. In a preferred embodiment, each lateral section 20 may be elastic or include a closing structure 42 for securing the left garment lateral section 20 to the right garment lateral section 20' to form a strap. A shoulder strap 22 further joins the front section 16 and back section 18 over the shoulder of a woman's torso on each of the left and right garment piece, 12 and 12'.

Figure 4:
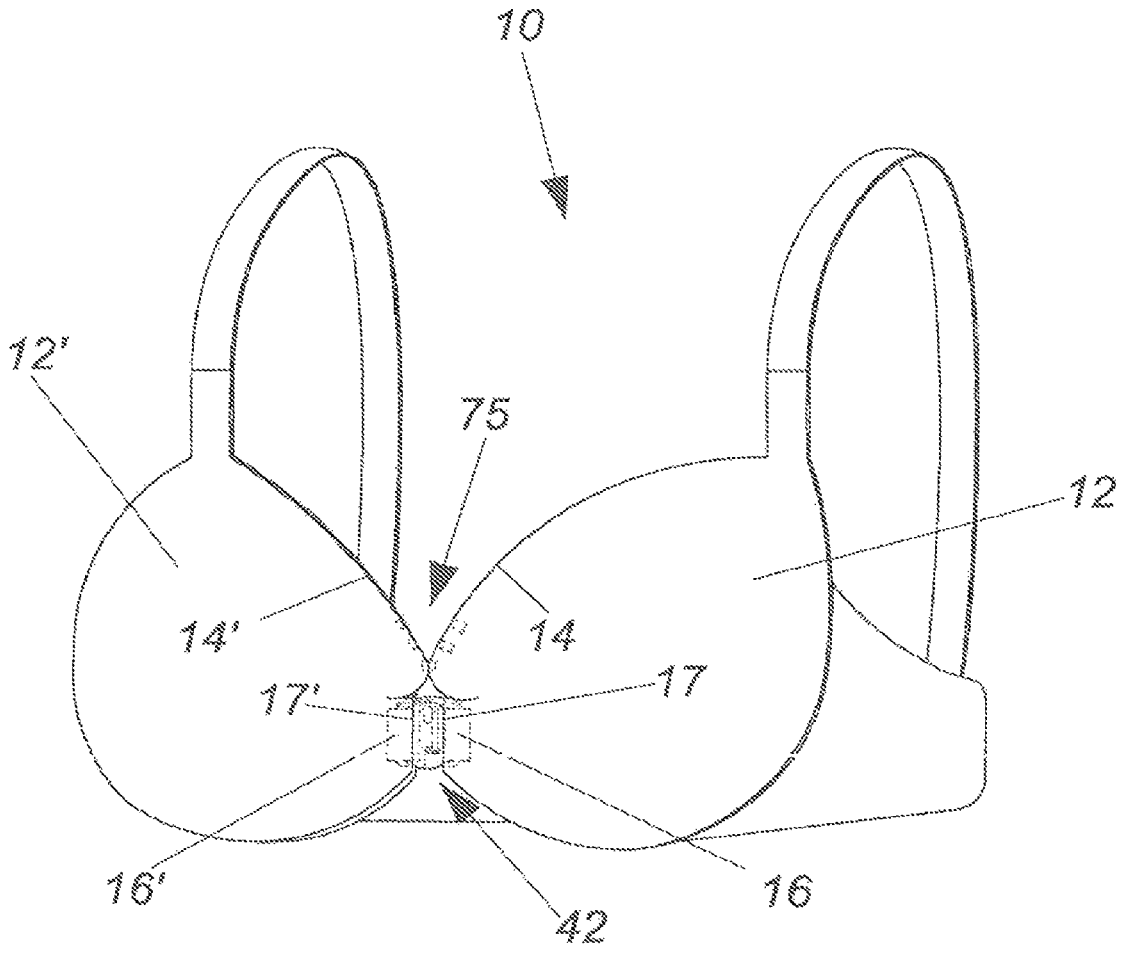
FIG. 4 is a front perspective view of the inner garment base using the front fastener of the instant invention.
Figure 5:
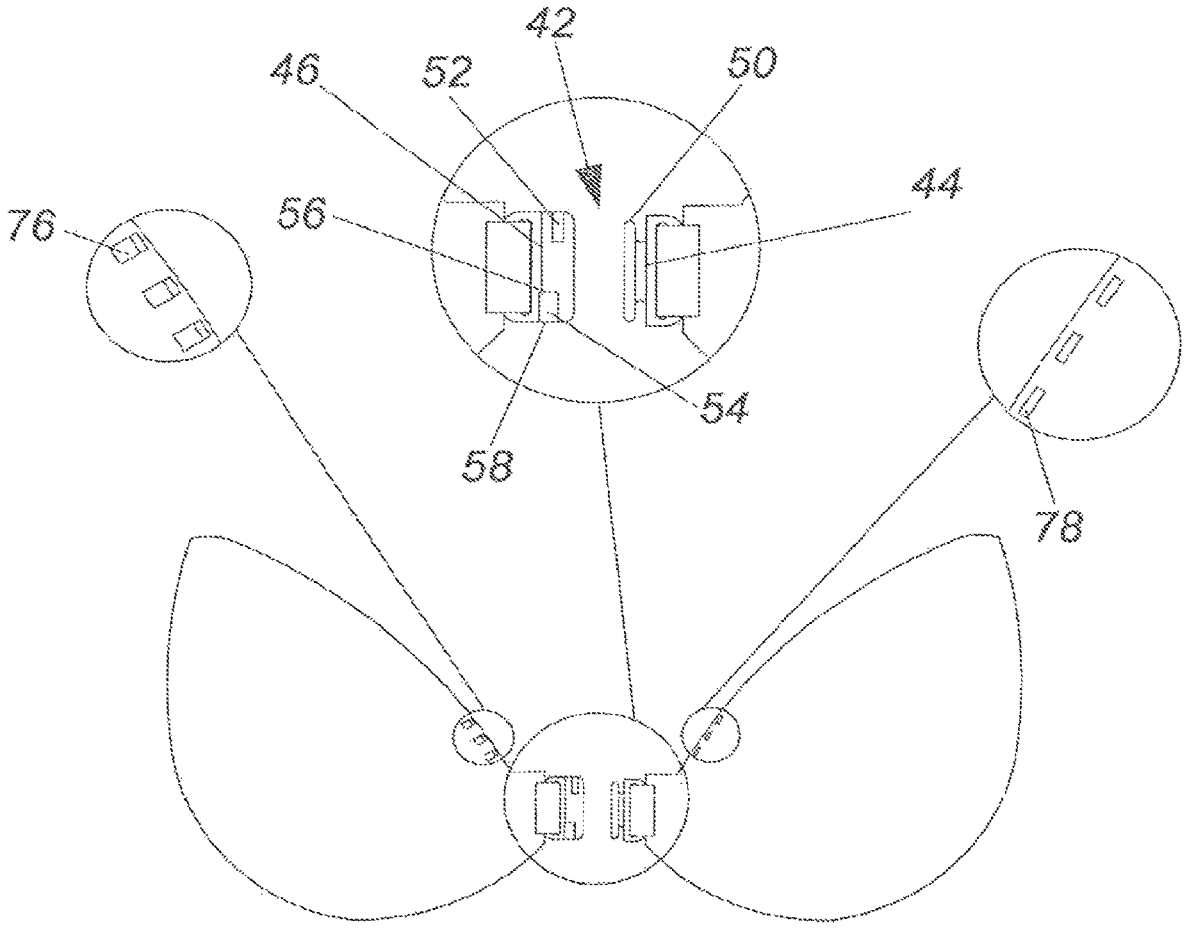
FIG. 5 is an enlarged back view of the closure structure and front fastener on the inner garment of the instant invention.

As shown in FIGS. 3-5, the left base 12 and right base 12' are releasably secured by use of a vertically oriented closure structure 42 preferably incorporated into an inelastic, edge seam 17 of each front section 16 for fastening the left base 12 and right base 12' of the garment pieces together. The vertically oriented front closure structure 42 incorporated into an inelastic, edge seam 17 and 17' of each front section 16 and 16' has a means for fastening the respective sections of the garment pieces together. Preferably, the closure structure 42 comprises of an engaging male portion 44 and engaging female portion 46 which can be engaged with and disengaged from each other in an upward direction. The male portion 44 includes a rod 50 for engaging a pair of recessed grooves, 52 and 54, on the female portion 46. The bottom recessed groove 54 has an open end 56 and a closed end 58 to not allow the rod 50 to be disengaged in a downward direction. Other fastening means contemplated include a conventional hook and eye fastener having a series of hooks on the left section for engaging eyes attached to the right section, not shown. The closure structure could also be a steady semi-flexible but stable support and a back latch, not shown. The back strap may be elastic or include a vertically oriented back closure structure formed into the edge seam of each back section having a means for adjustably fastening the respective left and right back sections of the garment pieces together.

Additionally, a front fastener 75 is shown on the inner garment base 10. A conventional hook and eye fastener 75 having a series of hooks 76 on the left garment breast cup 12, specifically the upper medial portion 14, for engaging eyes 78 attached to the right garment breast cup 12', specifically the upper medial portion 14'. The front fastener 75 is concealed from view, as it disposed on the inner surface of the inner garment 10. The front fastener 75 brings the left and right breast cups, 12 and 12', respectively, in closer proximity to each other, thereby bringing the wearer's breast in closer proximity. When in use, the front fastener 75 provides added cleavage for the wearer; and having a series of hooks 76 and eyes 78 allows the wearer to adjust the amount of cleavage to create the desired effect, more aptly shown in FIG. 4.

Figure 7:
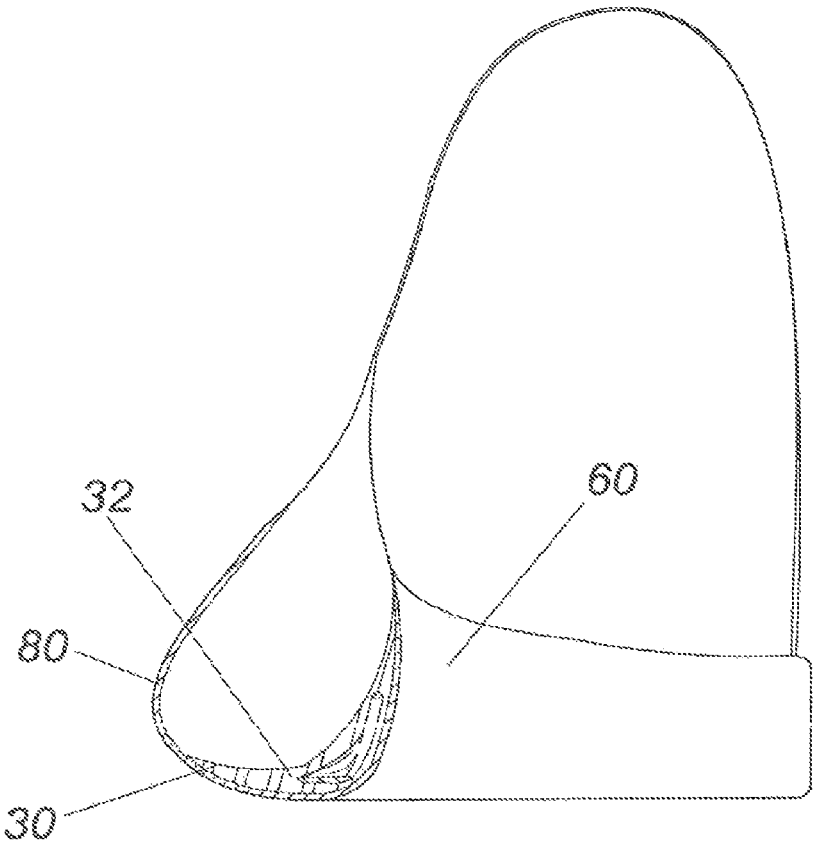
FIG. 7 is a side cross-sectional view of the improved brassiere.

As shown in FIGS. 1-3 and 7, the left base garment piece 12 is defined by a left breast support cup 24 and the right base garment piece 12' is defined by a right breast support cup 24'. Each breast support cup is constructed and arranged to surround a breast. An elastic polyurethane foam, 30 and 80, encapsulates the under support 60. The foam 30 and 80, commonly referred to as memory foam, can be both high and low density moldable foam that reacts to body pressure. The memory foam, 30 and 80, takes set by placement about the under support 60 with the pressure of the body allowing the breast to be comfortably positioned within each of the breast support cups 24. The foam, 30 and 80, encapsulates the under support 60 allowing the breast to be comfortably positioned within each of the support cups 24. The foam, 30 and 80, provides an extension of the ends of the under supports 60 without relying upon the rigidity of the plastic. As shown in FIGS. 3 and 7, the first memory foam 30 has larger thickness 32 about the lower lateral portion, 26 and 26', of each breast cup, 24 and 24', to facilitate in supporting the breast upward and medially. The memory foam about the under support provides comfort to the wearer, so the under support does not poke, scrap, protrude, or will cause pressure points on the skin of the wearer. Furthermore, the use of lift pads positioned on a lower lateral portion of each breast cup is contemplated for further support of the breast in upward and medial direction, not shown.

Figure 6:
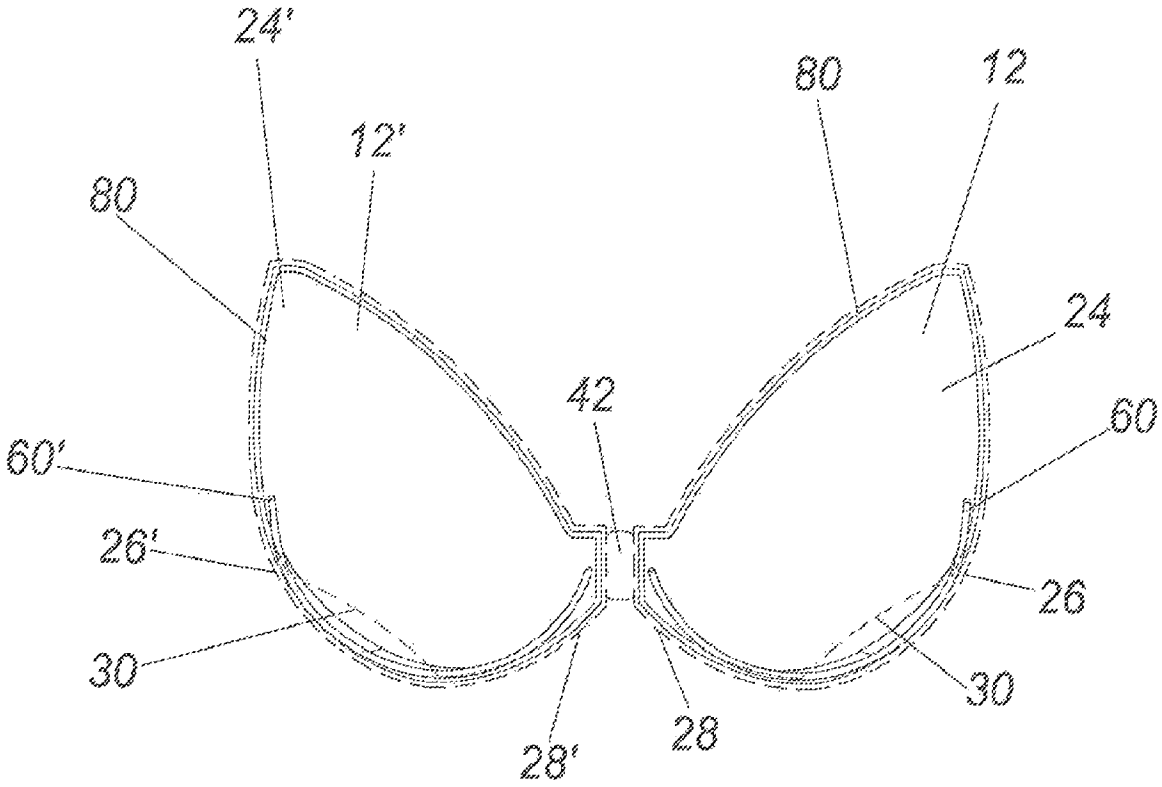
FIG. 6 is a front view of the inner garment base, memory foam and under supports of the instant invention.

As shown in FIGS. 6 and 7, the left breast support cup 24 has an under support 60, being encapsulated in memory foam 30 and 80, having an enlarged section 72 positioned on a lower lateral portion 26 of the left base 12 with a narrowing section 70 terminating at each end of the left base 12. The second breast support cup 24' has a right under support 60', being encapsulated in memory foam 30 and 80, having an enlarged section 72' positioned on a lower lateral portion 26' of the right base 12' with a narrowing section 70' terminating at each end of the right base 12'. The memory foam, 30 and 80, and the under supports 60 are positioned such so as to push each breast upwardly towards the neckline and medially. The compression between the inner garment 10, memory foam 30 and 80, and outer fabric 100 against the under support 60 maintain a set position of the under support 60 on a coronal plane; furthermore, in use, the breast provides additional compression against the under support 60. It is contemplated, not shown, that a clasp or the like may be used to maintain positioning of the under support within the brassiere.

Figure 8:
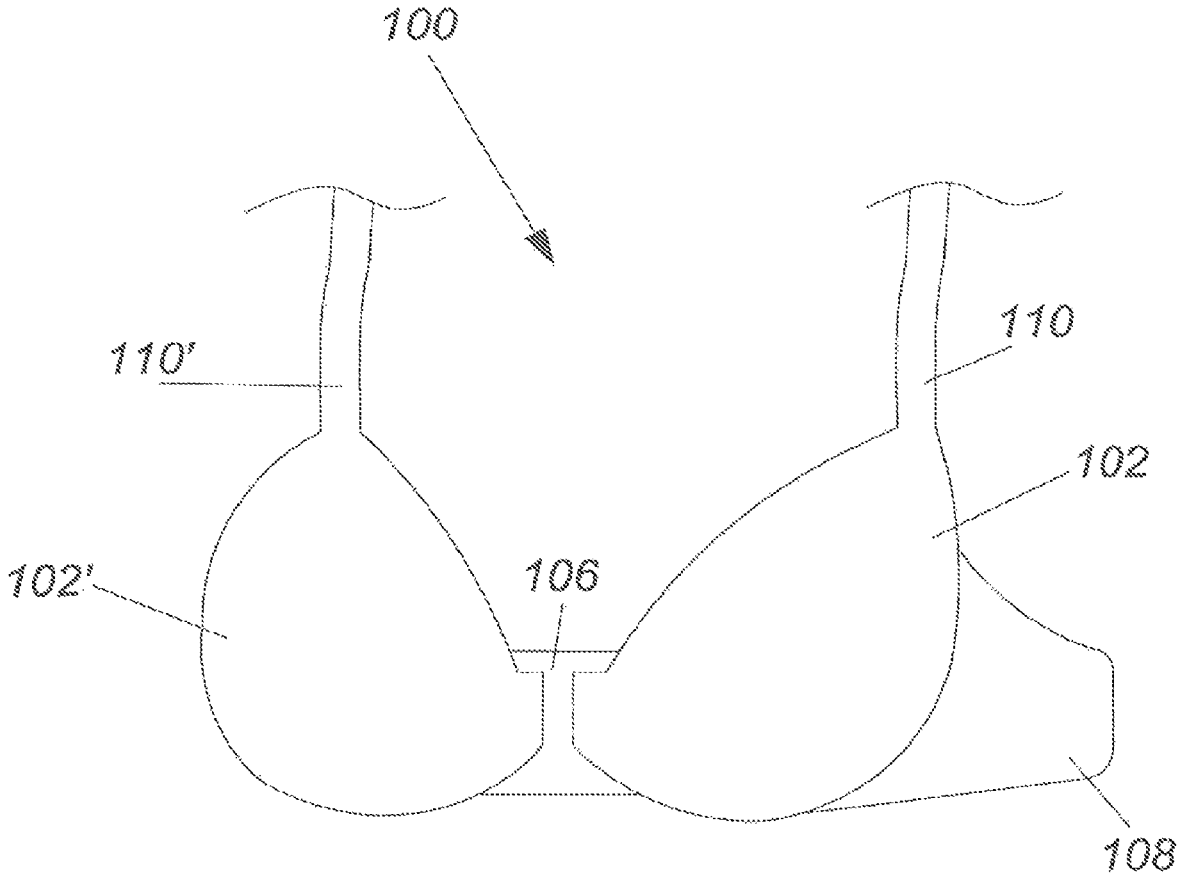
FIG. 8 is perspective view of the outer garment base of the instant invention.

As shown in FIG. 8, an outer fabric 100 is defined by an outer left base 102 having a back section 106, and a lateral side section 108 and a shoulder strap 110; and an outer right base 102' has a back section 106', a lateral side section 108', and a shoulder strap 110'. The lateral side 108 and shoulder straps 110 join the inner left 102 and right base 102'. The outer left and outer right base are attached to the inner left base garment piece 12 and the inner right base garment piece 12, respectively, more aptly shown in FIG. 2. The outer base may include decorative fabrics suitable for fashion wear, not shown.

Figure 9:
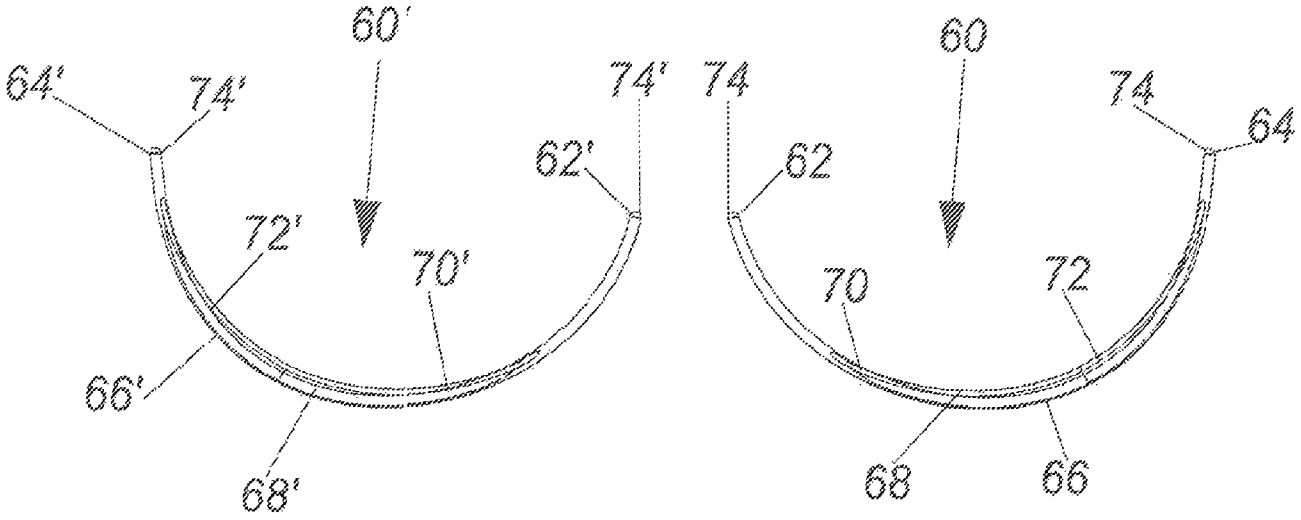
FIG. 9 is front view of the under supports of the instant invention.
Figure 10:
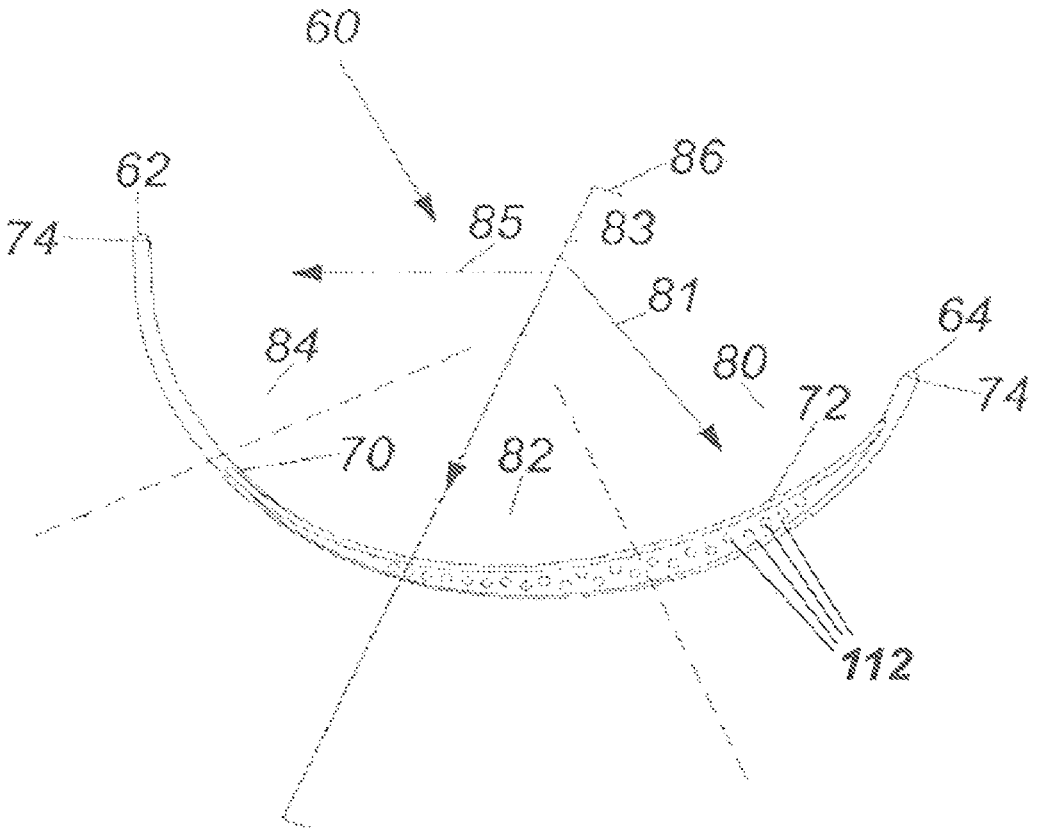
FIG. 10 is a perspective view of the under support of the instant invention.

Now referring in particular to FIGS. 9 and 10, a left and right breast under support 60 and is disclosed. The right under support 60' is a mirror image of the left under support 60. As such, it is understood that although each under support is designed for a right or left breast, their construction is the same. The under support 60 design which looks and mimics the natural shape of the human rib, features a substantially semi-circular shaped sling having an enlarged section 72 wider than the rest of the under support 60 that pushes or pulls the breast upward and medial. The positioning of the enlarged section 72 extending from distal edge 68 to proximal edge 66 and formed between the medial end 62 and lateral end 64, more offset to the lateral end 64, is a critical aspect to the comfort and supportive nature of the invention.

The under supports 60 can be constructed of various materials, including but not limited to polypropylene, acrylic copolymer, metal alloy, plastic composite, fiberglass, epoxy, carbon-graphite, or the like. The under supports 60 are preferably formed from a piece of ABS plastic material having rigidity from distal edge 68 to proximal edge 66 (distal is defined as the edge furthest from the body, and proximal is defined as the edge closest to the body). As used herein, the term "rigid", with respect to the under support 60, does not refer to absolute rigidity or stiffness. Rather, it is completed that a "rigid" member or component described herein allows for some amount of deformation when a sufficient amount of force is applied. The under supports 60 are flexible and have varying widths from a medial end 62 to lateral end 64 (medial is defined as the end towards the mid-line, away from the side, and lateral is defined as the end towards the side, away from the mid-line). Additionally, each under support has differing radii to accommodate the bottom portion shape of a breast implant, which is not a perfect semi-circle. The under support 60 has three different radii. Each radii covers a zone on the under support 60: the 1st radius 81 covers a 1st zone 80 from the lateral end 64 to about the enlarged section 72; the 2nd radius 83 covers a 2nd zone 82 stretching across the enlarged section 72; and, the 3rd radius 85 covers a 3rd zone 84 from about the narrowing section 70 to the medial end 62. The under support 60 has a distal edge 68 and a proximal edge 66. The proximal edge 66 is shaped to conform to the natural curvature under the breast. There are differing widths from proximal edge 66 to distal edge 68 along the length of the under support 60, with the largest width being along the enlarged section 72. In use, the lateral end of the under support is positioned approximately parallel to the nipple of the wearer and the medial end should be positioned below parallel relative to the nipple of the wearer, not shown.

Although the instant invention is primarily discussed with respect to the supporting of breasts with breast implants, it is contemplated that the instant invention is equally useful for supporting natural breast tissues or a combination of natural breast tissues and breast implants in the breast. Further, although the instant invention is primarily discussed with respect to support of breasts and breast implants in women, it is contemplated that similar configurations can be used for supporting breasts in men, such as men with abnormally large breast tissues, transgender men, or transsexual men.

From an anterior perspective, the left breast under support 60 begins with a lateral end 64 that transitions into a supporting enlarged section 72, tapers into a narrowing section 70, and terminates at the medial end 62. The medial end 62 is located on the bottom medial portion 28 of the breast supporting cup 24. The medial end 62 supports the medial bottom portion of the breast with a rounded edge 74 and curves downward under the infra-mammary fold of the breast, from an approximate 9 o'clock position at the terminating end, to a 7 o'clock position. The medial end 62 transitions from a superior to an inferior plane. At the 7 o'clock position the medial end 62 transitions to a narrowing section 70 from 7 o'clock to 6 o'clock. The narrowing section 70 has the smallest width along the under support 60 and then transitions to the largest width at the supporting enlarged section 72. The supporting enlarged section 72 begins at about the 6 o'clock position and continues to a 4 o'clock position. The enlarged section 72 is thus located under the breast implant, right above the infra-mammary fold. The width of the enlarged section 72 is approximately 1 cm. The lateral end 64 supports the lateral bottom portion of the breast, with a rounded edge 74 extending from a posterior curve about the curvature of the ribs (in the anterior-posterior plane) and lateral bottom portion of the breast in an approximate 4 o'clock position to a 3 o'clock position, at the terminating end. The lateral end 64 transitions from an inferior to a superior plane.

The under support width varies depending on the position along its length. The lateral end 64 and medial end 62 have an approximate width of about ¼ cm while the under support's largest width extends to about 2 cm at the enlarged supporting section 72. It is contemplated that the width of the under support at the ends and supporting section can be larger or smaller depending on the wearer's breast size. Should the women have a larger breast implant a larger supporting width than 2 cm would be required. The under support 60 further includes differing radii to accommodate the bottom portion shape of a breast implant, which is not a perfect semi-circle. As shown in FIG. 10, the under support 60 is broken up into three zones for the purposes of differentiating between the differing radii. The 1st zone 80 extends from the lateral end 64, at approximately 3 o'clock, to 5 o'clock and has a 1st radius 81 of approximately 2.3 in. The 2nd zone 82 which extends from approximately 5 o'clock to 7 o'clock has an approximate 2nd radius 83 of 2.9 in. The 3rd zone 84 which extends from 7 o'clock to the medial end 62 has an approximate 3rd radius 85 of 2.4 in. The differing radii are to accommodate the shape of the breast, as the bottom portion of the breast does not have a uniform radius. The radii do not originate from the same point; however all three radius extend across Datum Line 86.

As discussed above, various radii and various widths are contemplated for the under supports. The improved brassiere is contemplated for use with woman having augmented breasts, however the improved brassiere is compatible with woman having natural breast. FIG. 11 discloses the average implant size distribution on the global market as collected by the Mentor Corporation for MEMORYGEL® implants (trade name for Mentor Corporation for round silicone gel-filled breast implants). It is evident the majority of implants are within a volume range of 300 CC to 450 CC, and most commonly at 400 CC. It is well known, that various profiles exists for implants, FIG. 12 is data collected for MEMORYGEL® Smooth High Profile Implants (trade name for Mentor Corporation for round silicone gel-filled breast implants). FIG. 12 discloses the typical implant diameter and implant projection for various volume ranges. The data collected for use in MEMORY GEL® Smooth High Profile Implants shows that under supports would be most commonly constructed for use in woman with implants at volume of 400 CC with an approximate diameter of 12.2 cm and projection of 5.0 cm. The under support has a length from medial end to lateral end of approximately 13.25 cm. This length is substantial enough to accommodate an implant within the volume range of 300 CC to 450 CC. However, it is contemplated that under supports can be constructed of other lengths from medial end to lateral end to accommodate a larger or smaller implant. Additionally, the enlarged support section has a width of approximately 1 cm. Within a volume range of 300 CC to 450 CC, the projection of the implant varies from 4.5 cm to 5.1 cm. It is not the objective of the invention to provide an enlarged support section whereby the width of the enlarged support section is of equal dimension to that of the projection of the implant, as this construction would invariably create discomfort to the wearer and create an over-sized brassiere which is no longer appealing. It is the objective of the invention to provide an enlarged support section that will provide adequate lift, hold, and support to an implant and push the breast implant upwards and medially. Various widths for the enlarged support section can be manufactured to support larger or smaller volume sized implants.

One limitation of the configuration described above for brassiere 1 is that after repeated use, the position of the under support 60 with respect to the encapsulating memory foam 30 can potentially shift or move within the cavity of the memory foam 30 in which the under support 60 resides. Further, this can also result in the under support 60 piercing the encapsulating memory foam 30 or other portions of brassiere over time. As a result, not only can the comfort and fit of brassiere 1 be altered, but the brassiere 1 may be damaged.

In view of the potential issues described above, modifications to the under support 60 are contemplated. In particular, to secure the under support 60 in place with respect to the encapsulating memory form 30 and 80, it is contemplated that the under support further include openings to anchor or secure the under support 60 with respect to the memory foam 30 and 80. Thus, during the manufacturing process, the memory foam 30 and 80 will additionally extend through these openings to secure the under support 60 in place.

As shown in FIG. 10, this can be accomplished by including one or more openings 112 extending through portions of the under support 60 and positioned along the length of the under support 60. Although openings 112 are shown as a series of round openings of the approximately the same size in in FIG. 10, it is contemplated that the openings 112 can be of any size and or shape, including multiple sizes and shapes. Further, it is contemplate that the openings 112 can be placed in a regular or non-regular pattern. The positions and sizes of the one or more openings 112 in under support 112 can also be selected to ensure that the openings do not significantly affect the support characteristics of the under support 112.

Figure 13:
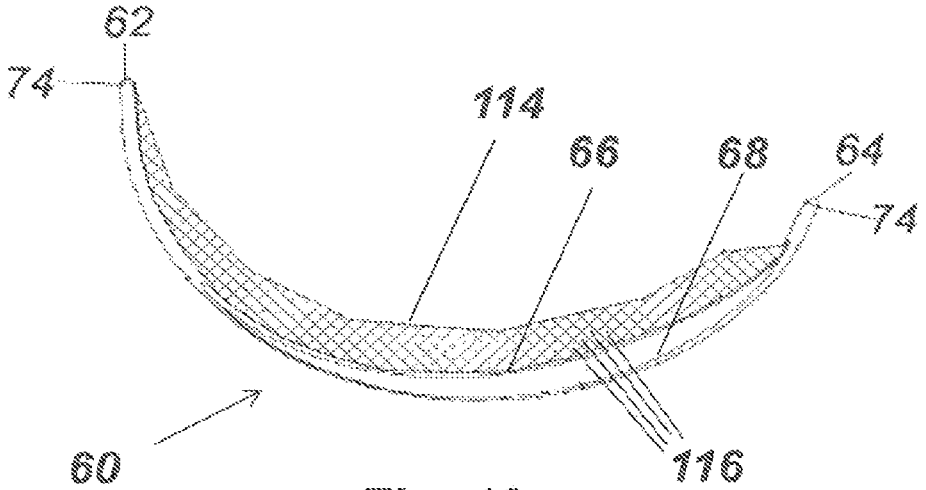
FIG. 13 is a perspective view of the under support of the instant invention with a single anchor section.
Figure 14:
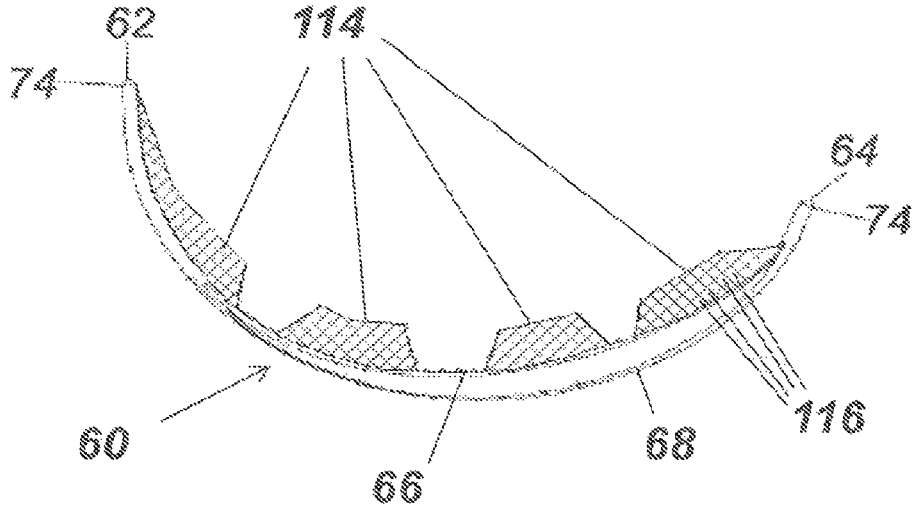
FIG. 14 is a perspective view of the under support of the instant invention with multiple anchor sections.
Figure 15:
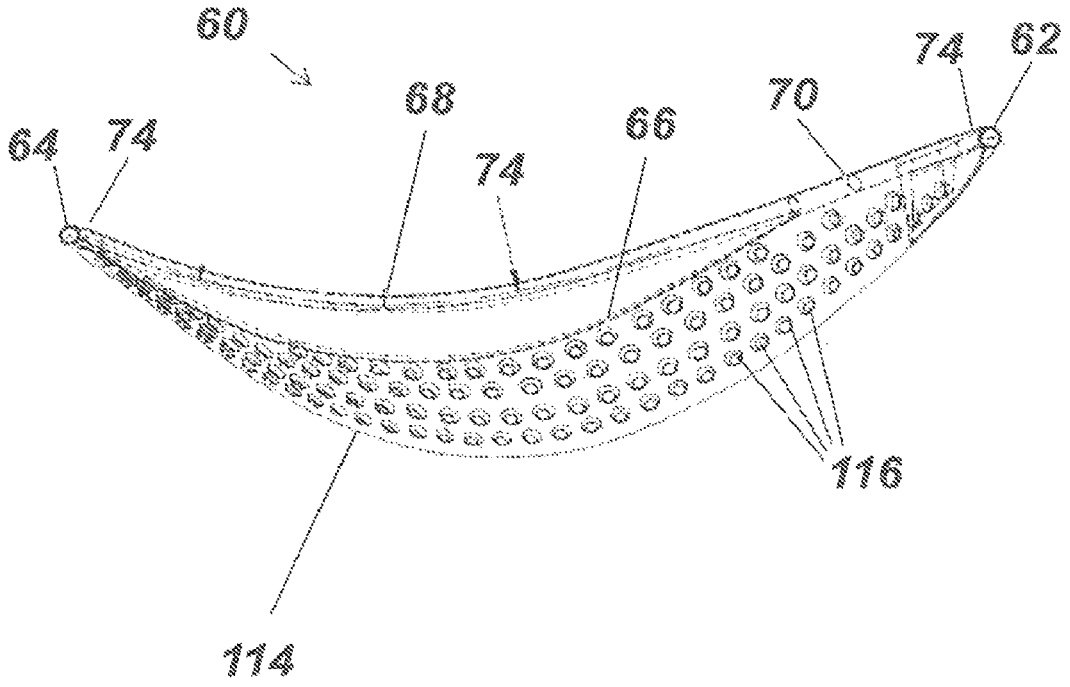
FIG. 15 is a perspective view of the under support of the instant invention with a single anchor section and an alternate configuration for openings in the anchor section.

Alternatively or in addition to the openings 112, it is also contemplated that the under support 60 can include one or more anchors 114 extending from the under support, as shown in FIGS. 13, 14, and 15. As shown in detail on FIGS. 13 and 14, the anchors 114 can be one member (FIG. 13) or multiple members (FIG. 14) extending from any or all of narrowing sections 70 and the enlarged section 72, along the distal edge 68 of the under support 60. That is, the anchors 114 extend away from the body. Although anchors 114 in FIG. 14 are show as being trapezoidal, it is contemplated that they can be any shape or size.

The anchors 114 are further configured with one or more openings 116. For example as shown in FIGS. 13 and 14, the configuration of openings 116 in anchors 114 can result in anchors 114 defining a mesh, i.e., a regular pattern of openings. However, it is also contemplated that the positions of the openings 116 need not be regular nor form a regular mesh. For example, FIG. 15 shows a configuration in which the openings 116 are formed using a series of circular openings. Further, the size and position of the openings 116 can vary.

The anchors 114 can be formed from a variety of materials. For example, the anchors 114 and the under support 60 can for integrally formed. However, as the anchors 114 are not required to provide support, they need not be formed from the same materials as under support 60 nor do they need to be as rigid as under support 60. For example, cloth and fiber-type materials can be used to form anchors. Further, polymers or elastomers can also be used. It is also contemplated that other materials not mentioned here can also be used.

In view of the foregoing, it is contemplated the anchors 114 can be formed from different materials and attached to the under support. In one configuration, the anchors 114 can be formed by applying a coating of a resilient or flexible material to at least partially surround the under support 60 and extending the coating material from the distal edge 68 to form anchors 114. In other configurations, a fastening system can be utilized to attach the anchors 114 to the under support. For example, clips, staples, or the like can be used. Alternatively, adhesives can also be used. Further, the under support 60 can include a groove or channel into which an edge of anchors 114 can be inserted into a held in place. It is also contemplated that a combination of such methods or other methods of attachment can also be used.

The configuration of the anchors 114 can also be selected based on the arrangement of the other components of brassiere 1. As noted above, the anchors 114 are provided such that the encapsulating memory foam 30 and 80 goes around and through the under support 60 to secure the under support 60 in place. However, it is contemplated that the amount and arrangement of memory foam 30 and 80 will vary. For example, there may be variations due to cup size. Accordingly, the configuration of the anchors 114, including size, shape, and position, can be selected to correspond to the amounts and placement of memory foam 30.

Further aspects of the instant invention are provided in the set of documents in Appendix A, the contents of which are herein incorporated by reference in their entirety.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

Figure 16:
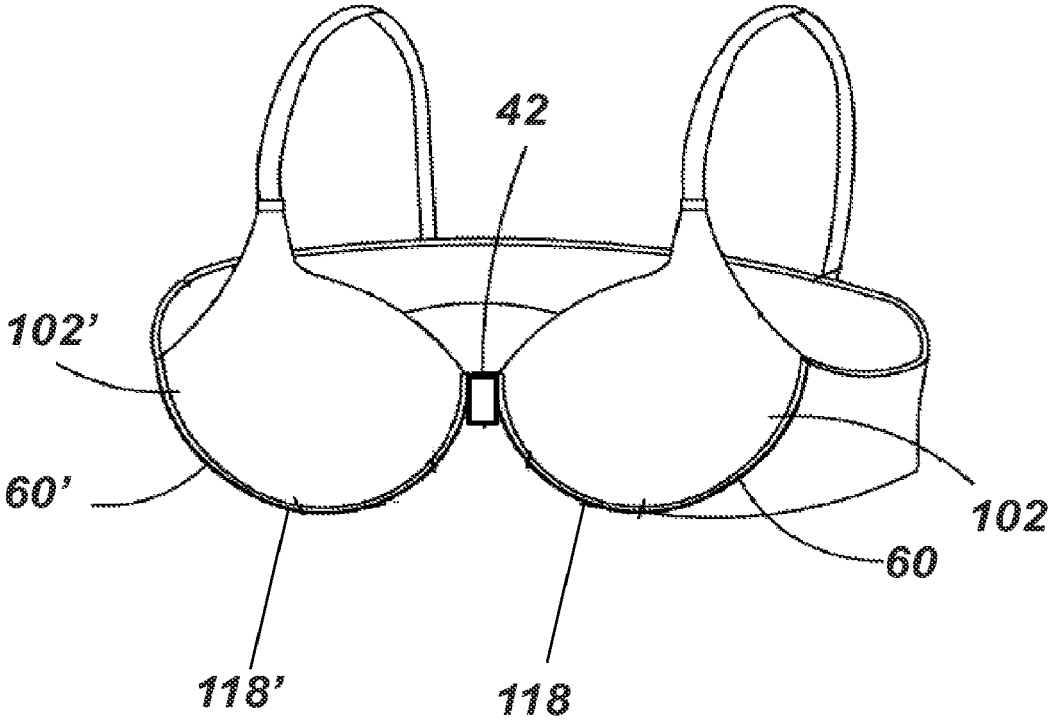
FIG. 16 is a front perspective view of an alternate configuration of the improved brassiere of the instant invention.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein. For example, it is contemplated that the under support 60 can be utilized in place of a conventional unwire. Alternatively, in addition to or alternatively to being encapsulated in the memory foam 30, the under support can be located in a channel 118, 118' as shown in FIG. 16. Such a channel can be positioned as required for supporting breast tissues or breast implants of various sizes to provide proper placement of the under support 60.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An under support for a breast support cup in a brassiere, comprising:

an enlarged section positioned on a lower lateral portion of the under support;

at least one anchor at a distal edge of the under support;

a medial end portion having a narrower width than the enlarged section;

a lateral end portion having a narrower width than the enlarged section;

wherein the under support is rigid, and wherein the at least one anchor extends away from the body.

2. The under support of claim 1, wherein the under support is curved from the medial end portion to the lateral end portion.

3. The under support of claim 2, wherein the medial end portion is curved along a first radius, wherein the lateral end portion is curved along a second radius, and wherein the enlarged section is curved along a third radius.

4. The under support of claim 3, wherein the third radius is larger than the first radius and the second radius.

5. The under support of claim 1, wherein the under support is curved from the medial end portion to the lateral end portion.

6. The under support of claim 5, wherein the medial end portion is curved along a first radius, wherein the lateral end portion is curved along a second radius, and wherein the enlarged section is curved along a third radius.

7. The under support of claim 6, wherein the third radius is larger than the first radius and the second radius.

8. The under support of claim 1, wherein the enlarged section comprises one or more openings.

9. The under support of claim 1, wherein the enlarged section comprises a plurality of openings.

10. The under support of claim 9, wherein each of the plurality of openings is the same size as the other openings.

11. A brassiere comprising the under support of claim 1, wherein the brassiere includes a first lift pad positioned between an inner bra fabric and an outer bra fabric on a first breast cup and a second lift pad positioned between an inner bra fabric and an outer bra fabric on a second breast cup.

12. The brassiere of claim 11, wherein the lift pads are positioned on a lower lateral portion of each breast cup.

* * * * *